United States Patent [19]

Bethurum

[11] Patent Number: 4,512,621

[45] Date of Patent: Apr. 23, 1985

[54] FLAT CABLE PITCH TRANSITION CONNECTOR

[75] Inventor: Gary C. Bethurum, El Segundo, Calif.

[73] Assignee: Thomas & Betts Corporation, Raritan, N.J.

[21] Appl. No.: 422,614

[22] Filed: Sep. 24, 1982

Related U.S. Application Data

[63] Continuation of Ser. No. 177,638, Aug. 13, 1980, abandoned.

[51] Int. Cl.[3] ..... H01R 13/39

[52] U.S. Cl. ..... 339/99 R; 339/75 M

[58] Field of Search ..... 339/75 M, 75 MP, 97 R, 339/97 P, 98, 99

[56] References Cited

U.S. PATENT DOCUMENTS

| | | | |
|---|---|---|---|
| 3,601,759 | 8/1971 | Barker | 339/75 MP |
| 3,816,818 | 6/1974 | Meier | 339/99 R |
| 3,930,708 | 1/1976 | Wedekind et al. | 339/99 R |
| 3,963,319 | 6/1976 | Schumacher et al. | 339/99 R |
| 3,964,816 | 6/1976 | Narozny | 339/99 R |
| 4,062,617 | 12/1977 | Johnson | 339/75 M |
| 4,076,362 | 2/1978 | Ichimura | 339/75 MP |
| 4,106,838 | 8/1978 | Jayne et al. | 339/99 R |
| 4,190,952 | 3/1980 | Thomas et al. | 339/99 R |
| 4,290,661 | 9/1981 | Burns | 339/75 M |

*Primary Examiner*—Joseph H. McGlynn

*Attorney, Agent, or Firm*—Robert M. Rodrick; Salvatore J. Abbruzzese

[57] ABSTRACT

A pitch transition connector has identical contact elements having insulation-piercing contacts arranged in two rows and spaced at the pitch of a flat cable. Each contact element has a further contact opposite its insulation-piercing contact and axially offset therefrom. The contact elements in one row are in 180-degree out-of-phase relation with those in the other row defining a pitch for the further contacts different from the flat cable pitch.

4 Claims, 7 Drawing Figures

FLAT CABLE PITCH TRANSITION CONNECTOR

This is a continuation of application Ser. No. 177,638, filed Aug. 13, 1980, now abandoned.

FIELD OF THE INVENTION

This invention relates to electrical connector assemblies and pertains more particularly to connector assemblies for providing connection between flat multiconductor cable and an array of electrical terminals having different pitch relationship than such flat cable.

BACKGROUND OF THE INVENTION

Various connection schemes are presently known for mass-terminating flat multiconductor cable and providing transition to electrical terminals of different pitch than the cable, as are discussed in the Statement filed herein pursuant to 37 CFR 1.97 and 1.98. Typically, such known schemes provide for pitch transition from multiconductor cable of standard pitch, i.e., wherein individual conductors are spaced on 0.050 inch centers, to pin configurations laid out in so-called D-connector variety, i.e., wherein the spacing between adjacent pins is 0.054 inches. Transition between such different pitch elements is provided either by the use of preformed electrical transition contacts supported in connector housings and extending between cable and terminals or by a connector involving contact elements having ends thereof fixedly supported and bendable central sections accommodating the pitch transition.

SUMMARY OF THE INVENTION

It is an object of the present invention to provide pitch transition connection from flat cable to other than D-configuration pin layout.

It is a more particular object of the invention to provide a pitch transition connector providing for pitch transition from the aformentioned standard flat cable to a pin layout involving pairs of pins laterally spaced, successive pairs being spaced by a preselected pitch different from that of the flat cable.

It is a still further object of the invention to provide for zero-insertion pitch transition connection between flat cable and terminals of accessory circuitry.

In attaining the foregoing and other objects, the invention provides a pitch transition electrical connector assembly for making connection to flat multiconductor cable of given pitch wherein a plurality of identical electrical contact elements are supported in an elongate housing, each contact element having a first contact of insulation-piercing type and a second contact opposite and axially offset from the first contact and arranged such that the first contacts are disposed in registry with the conductors of the flat multiconductor cable, i.e., are at such given pitch, and wherein the orientation of the contact elements is such that the second contacts are disposed at a predetermined pitch diverse from the given pitch of the cable conductors. In a particularly preferred embodiment, a base is provided for receiving the housing, the base circumscribing a fixed array of terminals adapted to register with the second contacts of the contact elements, the base and housing being movable relative to one another by an actuator to provide for electrical engagement of the second contacts and fixed terminals whereby continuity is provided between individual conductors of the flat cable and such terminals of the array.

The foregoing and other objects and features of the invention will be further understood from the following detailed description of a preferred embodiment of the invention and from the drawings wherein like reference numerals identify like parts throughout.

DETAILED DESCRIPTION OF THE PREFERRED EMBODIMENT

Figure 4:
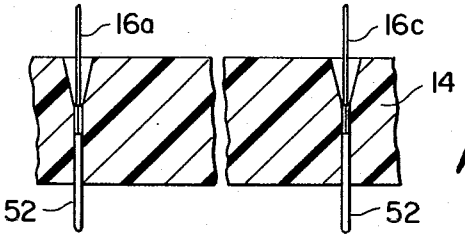
FIG. 4 is a front elevation of the base member of the FIG. 1 assembly as seen interiorly of the front wall thereof.
Figure 5:
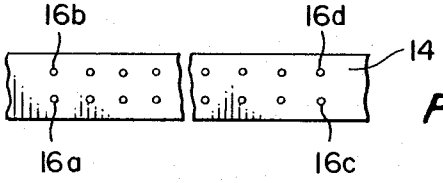
FIG. 5 is a bottom plan view of the base of the FIG. 1 connector assembly.
Figure 1:
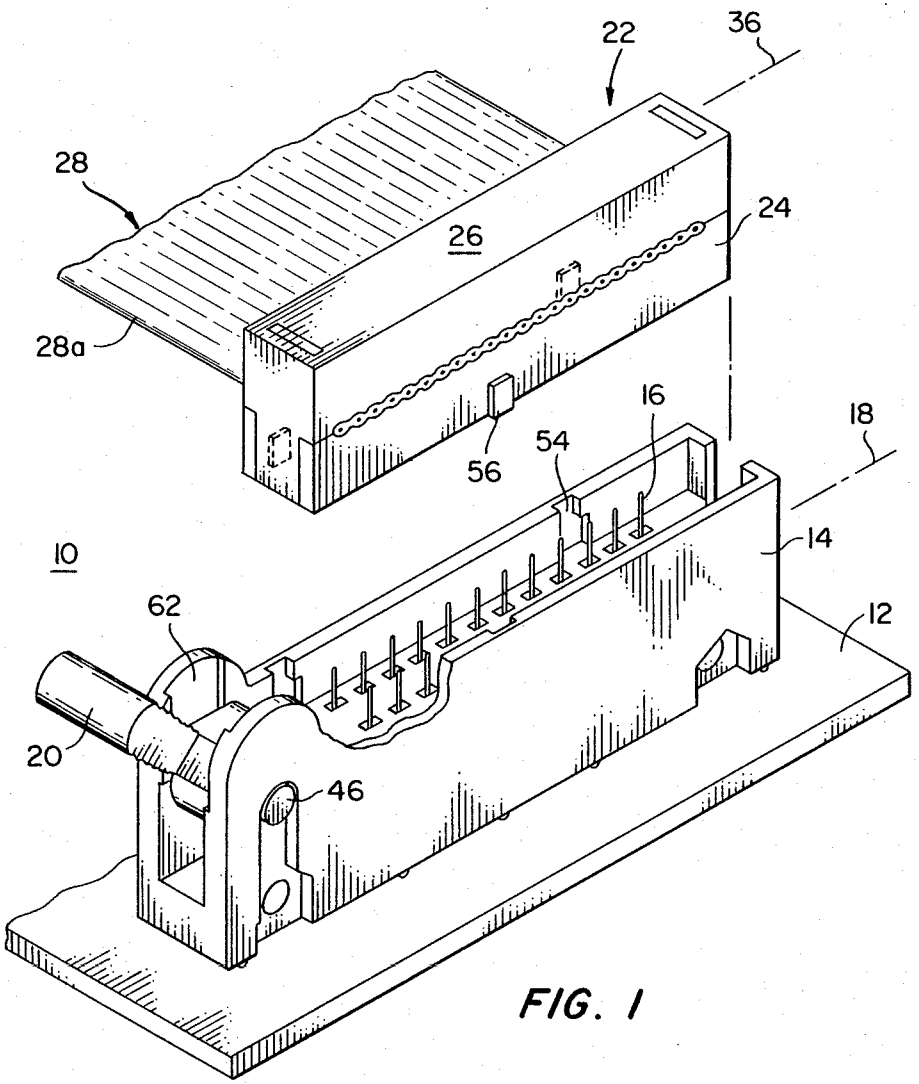
FIG. 1 is a perspective and partly exploded view of a connector assembly in accordance with the invention.

Referring to FIG. 1, connector assembly 10 is mounted on a printed circuit board 12 and includes a male header or base 14 circumscribing header terminal pins 16 which are electrically connected to conductive strips (not shown) on board 12. Base 14 is elongate about axis 18 and, as is shown in FIGS. 4 and 5, terminals 16 are arranged in longitudinally spaced laterally aligned pairs, e.g., terminals **16*a* and 16*b* comprising one pair in lateral alignment are spaced along base 14 from the terminal pair comprising terminals 16*c* and 16*d*. Base 14 pivotally supports at one end thereof an actuator 20**, for purposes discussed below.

Figure 2:
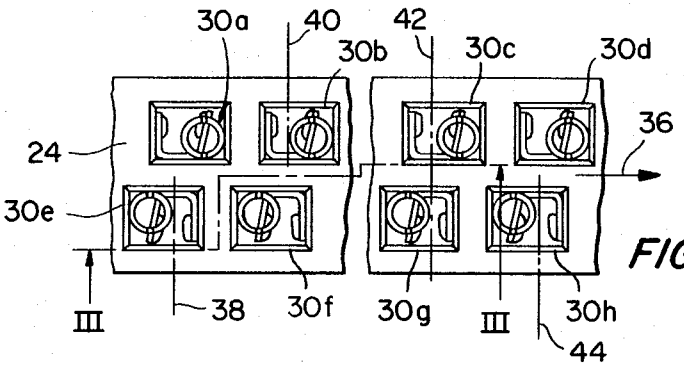
FIG. 2 is a partial plan elevation of the housing of FIG. 1, indicating the dispositions of contact elements in the housing.
Figure 3:
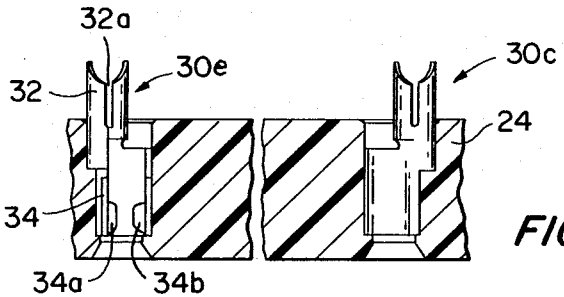
FIG. 3 is a front elevation view in section along plane III—III of FIG. 2.

Connector 10 further includes a female socket 22 having a housing 24 and a cover 26, the cover being separable from the housing to provide for disposition of flat multiconductor cable 28 in registration with housing contact elements shown particularly in FIGS. 2 and 3.

A grouping of such housing contact elements **30*a*–30*h* is shown in plan view in FIG. 2 and contact elements 30*e* and 30*c* are shown in front elevation in FIG. 3. All of contact elements 30*a*–30*h* are of identical configuration, each including a first end contact 32 of insulation-piercing type and a second end contact 34 opposite contact 32 and axially offset therefrom. First contacts 32 may be of configuration shown particularly in U.S. Pat. No. 3,964,816, commonly assigned herewith and defining a slot 32*a* along the axis of contact 32 for receiving the conductors of cable 28 and electrically engaging the same during insulation piercing of the cable. In the illustrated embodiment, contact 34 is of socket type, including fingers 34*a* and 34*b* aside the central axis of contact 34**.

As is further seen from FIGS. 2 and 3, the housing contact elements are arranged in first and second rows aside longitudinal axis 36 of housing 24. Those contact elements which are resident in the row shown upwardly of axis 36 in FIG. 2, i.e., contact elements **30*a*–30*d*, are in orientation or attitude such that the insulation-piercing contact 32 is rightward of contact 34 for each contact element. On the other hand, each of the housing contact elements disposed in the lower row in FIG. 2 are in orientation or attitude of opposite sense or phase from that of contact elements 30***a*–30*d*. Thus, in the case of contact elements 30*e*–30*h*, the insulation-piercing contact of each contact element is situated leftwardly of its contact 34. The contact elements are further supported in housing 24 such that the spacing longitudinally between center lines of adjacent insulation-piercing contacts is equal to the pitch of cable 28. Thus, the spacing along axis 36 between the center lines of the insulation-piercing contacts of contact elements 30*e* and 30*a*, between the center lines of the insulation-piercing contacts of the contact elements 30*a* and 30*f*, etc., is equal to the spacing between the center lines of adjacent conductors of cable 28. This arrangement accommodates registration of the insulation-piercing contacts of all contact elements with cable 28. Electrical engagement therebetween is provided by suitable tooling which forces cover 26 into suitably latched engagement with housing 24, whereupon the individual conductors are driven into slots 32*a* of contacts 32.

Since the contact elements of opposite rows are effectively rotated into 180-degree opposite phase relationship, and since the center line spacing between contacts 32 and 34 is identical for all contact elements, the center lines of second contacts of laterally facing contact elements are laterally in alignment. Thus, contacts 34 of contact elements 30*a* and 30*e* are aligned laterally along lateral or transverse axis 38. Contacts 34 of contact elements 30*b* and 30*f*, 30*c* and 30*g*, and 30*d* and 30*h* are aligned laterally along transverse axes 40, 42 and 44, respectively.

By virtue of the geometry imposed in the connector as a result of the manner of support of identical contact elements and the opposite phase arrangement thereof, one readily provides a transition pitch multiple of two, i.e., the spacing between longitudinally successive and laterally aligned pairs of contacts 34 being twice that of the spacing between longitudinally successive insulation-piercing contacts 32. Otherwise stated, the pitch provided in the array of contacts 34 may be of predetermined measure exceeding the given pitch of the flat cable.

Figure 6:
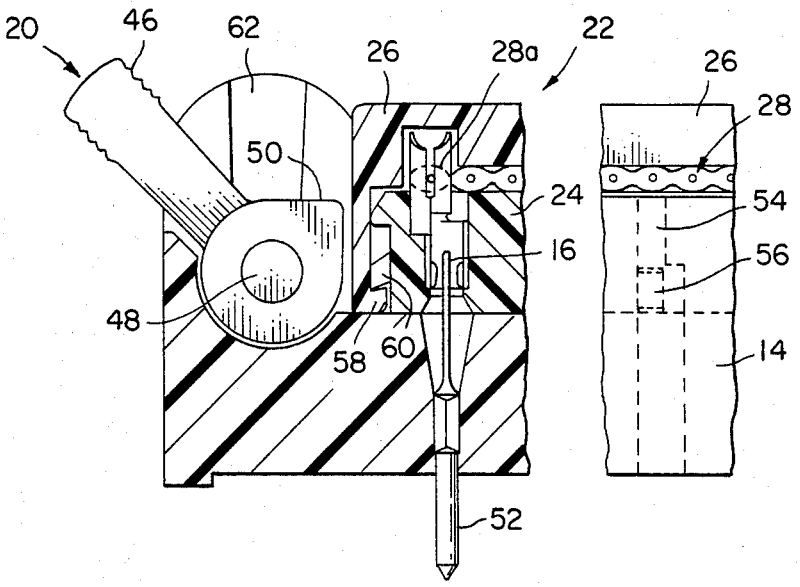
FIG. 6 is a front elevation illustrative view of the connector assembly of FIG. 1 with the actuator member thereof in unoperated disposition.

Referring to FIG. 6, socket assembly 22 is shown in assembled relation with base 14, terminals 16 being aligned with the lateral axes of alignment of contacts 34 and hence being centrally disposed within contacts 34. Terminals 16 are free at this stage of interference with contacts 34 and the assembly of socket assembly 22 and base 14 may be characterized as being of zero-insertion force nature. Upon operation of actuator 20, i.e., upon clockwise rotation of actuator handle 46 on pivot pin 48 of base 14, actuator cam 50 moves into engagement with cover 26 and slidably displaces socket assembly 22 longitudinally along base 14, the completion of such relative movement between the socket assembly and base being shown in FIG. 7. In such FIG. 7 disposition of the parts of the connector, contact finger 34*a* engages terminal 16 to provide electrical connection between cable conductor 28*a* and pin 52 extending outwardly of base 14 for connection to the printed circuit board conductive strip or other like accessory circuit.

Figure 7:
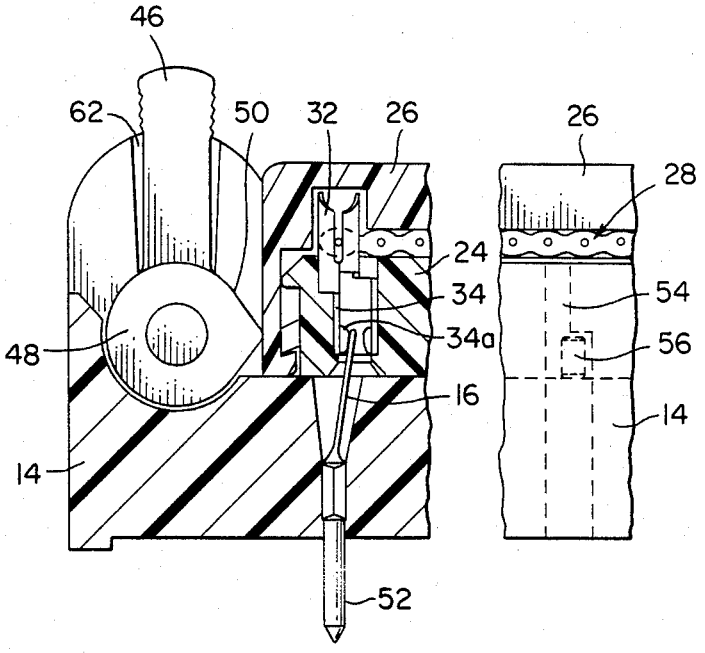
FIG. 7 is a successor view to FIG. 6 wherein the actuator member is shown in operated disposition.

Various latching structure may be provided for mechanically interlocking the components of the connector assembly. Referring to FIG. 1, the interior walls of base 14 may define slots 54 of illustrated stepped configuration. Housing 24 may likewise have tabs 56 extending outwardly thereof in registry with slots 54 to enter the slots as the parts are assembled. Upon such longitudinal movement of the socket assembly relative to base 14, the tabs and slots are moved into latching registry, as indicated in FIG. 7. Releasable assembly of cover 26 to housing 24 may be provided by a suitable detent arrangement, shown by elements 58 and 60 in FIGS. 6 and 7. Finally, actuator handle 46 may be in releasable latched relation with slot 62 (FIG. 6) when the actuator is in its operated disposition shown in FIG. 7.

While the invention has been shown in a particularized embodiment, various changes may be introduced without departing from the invention, as will now be evident. For example, the socket configuration for contacts 34 and the pin configuration for terminals 16 may be reversed such that the housing-supported contact elements include a first contact of insulation-piercing character and a second contact of pin configuration opposite and axially offset from the insulation-piercing contact. Also, it will be seen that the socket assembly 22 may have application other than to connection with a base configured as a header and may also find application in instances where zero-insertion force is not required. The foregoing particularly described and disclosed embodiment is accordingly intended in an illustrative and not in a limiting sense. The true spirit and scope of the invention are set forth in the following claims.

What is claimed is:

1. A pitch transition electrical connector assembly for making zero-insertion force connection between flat multiconductor cable of given pitch and an array of fixed electrical terminals having a given outer dimension, comprising:

a plurality of identical electrical contact elements, each having a first contact of insulation-piercing type and a second contact opposite and axially offset from said first contact, said contact including a socket portion defining a terminal receiving region having an access greater than said given outer dimension of said terminals;

an elongate housing adapted for receiving said cable and for engaging said contact elements therewith, said housing supporting said contact elements with such first contacts thereof in laterally spaced first and second rows, longitudinally successive ones of said first contacts being spaced by said given pitch, said housing supporting said second contacts in respective pairs, said contacts of each such pair being spaced mutually in lateral alignment, longitudinally adjacent ones of said pairs being spaced by a predetermined pitch exceeding said given pitch;

an elongate base circumscribing such terminal array and adapted for receiving said housing and placing said terminal receiving region of said second contacts individually in circumscribing relation about the respective terminals of the terminal array in preselected non-engaging registry with such terminals; and actuator means for effecting relative longitudinal movement of said housing and said base to place said terminal contacting member of said second contacts individually in electrical engagement with said array terminals.

2. The assembly claimed in claim 1 wherein said housing supports those of said contact elements having first contacts in said first row in one orientation and supports in orientation opposite said one orientation those of said contact elements having first contacts in said second row.

3. The assembly claimed in claim 1 further including a cover member releasably secured to said housing and defining with said housing a passage for disposition of said cable in said assembly.

4. The invention claimed in claim 1 wherein said terminals of said array are of pin configuration.

* * * * *